US010235851B2

(12) United States Patent
Romero Redondo et al.

(10) Patent No.: US 10,235,851 B2
(45) Date of Patent: Mar. 19, 2019

(54) SECURITY SYSTEM AGAINST THE RISK OF FIRES

(71) Applicants: Alfredo Romero Redondo, Madrid (ES); Mariano Garcia Carretero, Madrid (ES); Pedro Sanz Frutos, Madrid (ES); Roberto Garcia Carretero, Madrid (ES)

(72) Inventors: Alfredo Romero Redondo, Madrid (ES); Mariano Garcia Carretero, Madrid (ES); Pedro Sanz Frutos, Madrid (ES); Roberto Garcia Carretero, Madrid (ES)

( * ) Notice: Subject to any disclaimer, the term of this patent is extended or adjusted under 35 U.S.C. 154(b) by 0 days.

(21) Appl. No.: 15/574,341

(22) PCT Filed: Jun. 11, 2015

(86) PCT No.: PCT/ES2015/070460
§ 371 (c)(1),
(2) Date: Nov. 15, 2017

(87) PCT Pub. No.: WO2016/198703
PCT Pub. Date: Dec. 15, 2016

(65) Prior Publication Data

US 2018/0137722 A1 May 17, 2018

(51) Int. Cl.
*G08B 17/10* (2006.01)
*G08B 7/06* (2006.01)

(52) U.S. Cl.
CPC ..... *G08B 7/066* (2013.01); *G08B 7/062* (2013.01); *G08B 17/10* (2013.01)

(58) Field of Classification Search
CPC ..... G08B 7/066; G08B 7/10; G08B 25/009; G08B 7/062; G08B 17/10
See application file for complete search history.

(56) References Cited

U.S. PATENT DOCUMENTS

| | | | | |
|---|---|---|---|---|
| 2,816,280 | A | 10/1957 | Detweiler | |
| 4,419,658 | A | 6/1983 | Jarosz et al. | |
| 4,540,980 | A | 10/1985 | Porco | |
| 6,181,251 | B1 * | 1/2001 | Kelly ..... | G08B 7/062 340/628 |

(Continued)

FOREIGN PATENT DOCUMENTS

| | | |
|---|---|---|
| ES | 1098458 | 1/2014 |

OTHER PUBLICATIONS

International Search Report, PCT/ES2015/070460 dated Mar. 3, 2016.

*Primary Examiner* — Phung Nguyen
(74) *Attorney, Agent, or Firm* — Porzio Bromberg & Newman P.C.

(57) ABSTRACT

Security system against the risk of fire comprising a first fire detection element (1) connected by a flexible bridge (3) to a second fire detection element (2), with the first fire detection element (1) having some first means of lighting (4), while the second fire detection element (2) has some means of lighting (5), where the means of lighting are LEDs, in different colors, whereby achieving an easy to position detection system without any installation, that is valid for the deaf and provides information on escape routes. The system is designed to be mounted on the top edge of doors or elements of passage.

6 Claims, 2 Drawing Sheets

(56) References Cited

U.S. PATENT DOCUMENTS

| | | | | |
|---|---|---|---|---|
| 2008/0258904 | A1* | 10/2008 | Moss | G08B 3/10 340/506 |
| 2009/0109016 | A1* | 4/2009 | Baker | G08B 1/08 340/506 |
| 2014/0104067 | A1* | 4/2014 | Chien | G08B 17/10 340/628 |
| 2014/0313040 | A1* | 10/2014 | Wright, Sr. | G08B 17/10 340/628 |

* cited by examiner

SECURITY SYSTEM AGAINST THE RISK OF FIRES

OBJECT OF THE INVENTION

The object of the present invention, as the title establishes, is a security system against the risk of fires, that is, it refers to a fire detector assembly that operates autonomously in charge of detection of the presence of smoke in the air, emitting an acoustic signal warning of the danger of fire.

This system is characterised by the fact that it has the means to enable its easy placement without installation, earlier and more effective detection and some means or luminous signals that indicate the escape route.

Therefore, the present invention is limited within the field of fire and smoke detector devices.

BACKGROUND OF THE INVENTION

According to the detection method used by smoke detectors they can be of several types:

- Ionic detectors: used for detection of combustion gases and smoke that are not visible to the naked eye.
- Optical detectors: detect visible smoke by means of absorption or diffusion of the light.
- Optical or photoelectric detectors can be of two types, depending on how they detect the smoke by darkening or by dispersion of the air in a space.
- Infrared rays: they are comprised of a transmitter device and another receiver device. When the space between them is darkened by smoke, only a fraction of the emitted light reaches the receiver, making the electrical signal produced by the latter be weaker and activating the alarm.
- Point detector: in these, the transmitter and receiver are housed in the same chamber, but do not see each other as their axes form an angle of over 90° and they are separated by a screen, so that the beam emitted does not reach the receiver. When smoke enters the chamber, the emitted light beam is refracted in smoke particles and can reach the receiver, activating the alarm. It is the most commonly used technology today.
- Laser: they detect a darkening of an agglutination chamber with laser technology.

Autonomous smoke detectors are small appliances that detect smoke; they are equipped with a buzzer, a siren that emits a sound that alerts us in the case of fire. Although there is currently no obligation to use them in housing there are many housing studies that demonstrate and support the effectiveness of these appliances. Manufacturers recommend a series of measures for their best location and the areas to be avoided.

All areas have their pros and cons. What has really been proven is as follows: Doors are a wonderful ally to prevent the spread of both the gases and smoke produced by incomplete combustion but on the contrary they are a problem in the response time for detecting a fire as they prevent the progression of the smoke.

The recommendations of the manufacturers tell us to position at least one detector per floor with this being the minimum protection.

On the other hand, currently all detectors are supplied with small screws and a platform or base on which the detector will be placed, that although seemingly simple, is not, as it requires a drill and ladders for its correct positioning.

The detector requires maintenance or supervision, and careful reading of the instructions is essential along with the customisation required due to the special characteristics of our home.

The fact that autonomous detectors are only equipped with acoustic signals such as a siren limits their use to people who are not deaf, and are of no use to those who are deaf.

In addition, state of the art detectors do not provide information about escape routes, which are the most correct or appropriate ones.

Consequently, regardless of the nature or type of detector, we encounter difficulties relating to their assembly, their maintenance, to their impossibility of being useful for the deaf, and to not indicating the escape routes and aspects that can be improved such as the choice of the assembly point for a faster and more effective detection.

Therefore, the object of the present invention is to overcome the drawbacks pointed out developing a security system against the risk of fire as that described below and which is reflected in its essence in the first claim.

DESCRIPTION OF THE INVENTION

The object of the present invention a security system against the risk of fire wherein it comprises a first fire detection element joined by a flexible bridge to a second fire detection element and which is mounted on a door or similar element of passage with each of the detection elements arranged on each of the sides of the door or element of passage.

Furthermore, the first fire detection element, and the second fire detection element are each equipped with lighting means, preferably LEDs, although not restricted to this, and may come in different colours.

The presence of the light means associated with each fire detector element that are activated in case of fire detection, allow indication also for the deaf.

If the luminous means were to have different colours and thanks to the fact that they are mounted on both sides of a door or access element, it would be possible to use such colours as indicator codes of the feasibility of the escape routes. Thus, green would indicate the possibility to being able to go out through the door the fire detector element is mounted on, while red would indicate the non-advisability of going out through said door or element of passage or the advisability of closing or not opening it.

This is extremely useful, since in fires, behind a door or element of passage, we do not know what we are going to find on the other side, and thanks to the system having a double set of detector elements positioned on both sides of a door and connected, allows being able to reflect in one element the information of what is happening in the other element, in addition to reporting on the feasibility of the escape routes.

In addition and additionally the system can be connected to a smartphone, where it is possible to program the different levels of sensitivity or activation or deactivation, and of course allows the possibility of integration in a fire detection system which may have an alarm centre or security personnel.

In addition it would also be possible to equip one or the two fire detection elements with video surveillance means.

In the event that the security system were to have more than one set as those described, intercommunication between them is possible, so that when one of them is activated both the acoustic and lighting indication means of the rest of the sets activate and can even establish a safe escape route in the building they are mounted in.

Thus thanks to the constructive characteristics the detector device can be placed on the top edge of a door simply without having to use additional tools, on the other hand, and as a result of having two detectors, the fire detection is enhanced, regardless of whether the door is open or closed.

Also, as a result of their arrangement on the doors or elements of passage, a more efficient detection is achieved, since the doors serve in the drawing or passage of smoke, particularly in fires in which it takes time for flames to occur, but which, however produce large amounts of smoke.

The detectors can be of sensitive autonomous photoelectric technology, i.e. each operates independently, are hung on either side of the lintel of a door by means of the top edge of the door, using for this a plastic or other flexible material bridge that connects the two detectors.

This detector is suitable for use both in large buildings and homes, in small boats, caravans, camper vans, also in sub-standard housing, in shacks or places that given their construction characteristics their use is even more indicated due to the amount of fire load and overcrowding, propagation being faster.

With the detector installation is facilitated, only opening and hanging, we improve detection and customised configuration since the detector becomes an active and mobile part (perfectly stable and integrated) and it can be used in second homes in the summer, the quick change of its allocation is allowed for depending on the needs, facilitating its use, cleaning and low maintenance as well as actively integrating it in the security of our homes. With this new detector configuration given its strategic location and features we make household security universal and easy.

Therefore thanks to the detection system object of the invention the following is achieved:

- a detection system without installation placed in the strategic place for early detection and light projection
- a detection system valid for the deaf
- a detection system that indicates if it is advisable to cross the door where it is mounted, and if associated to other detection assemblies the safest escape route.
- a detection system connectable to a smartphone
- a detection system that can be integrated in an alarm centre.

EXPLANATION OF THE FIGURES

To complement the description being made and in order to aid a better understanding of the characteristics of the invention according to a preferred practical embodiment thereof, accompanying as an integral part of said description, a set of drawings are attached, which are of a merely illustrative nature and are not restricted to, showing the following.

PREFERRED EMBODIMENT OF THE INVENTION

In view of the figures a preferred embodiment of the invention proposed is described below.

Figure 1:
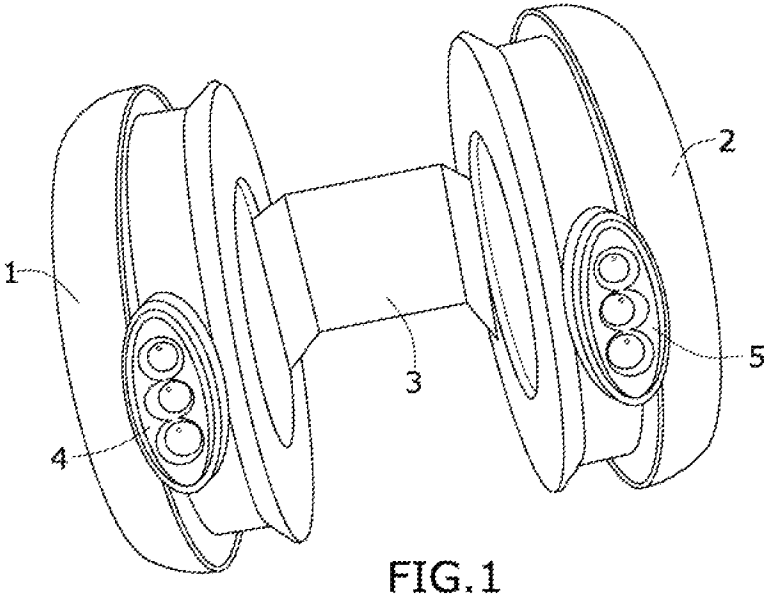
In FIG. 1 can be observed the security system against the risk of fire of the invention.
Figure 2:
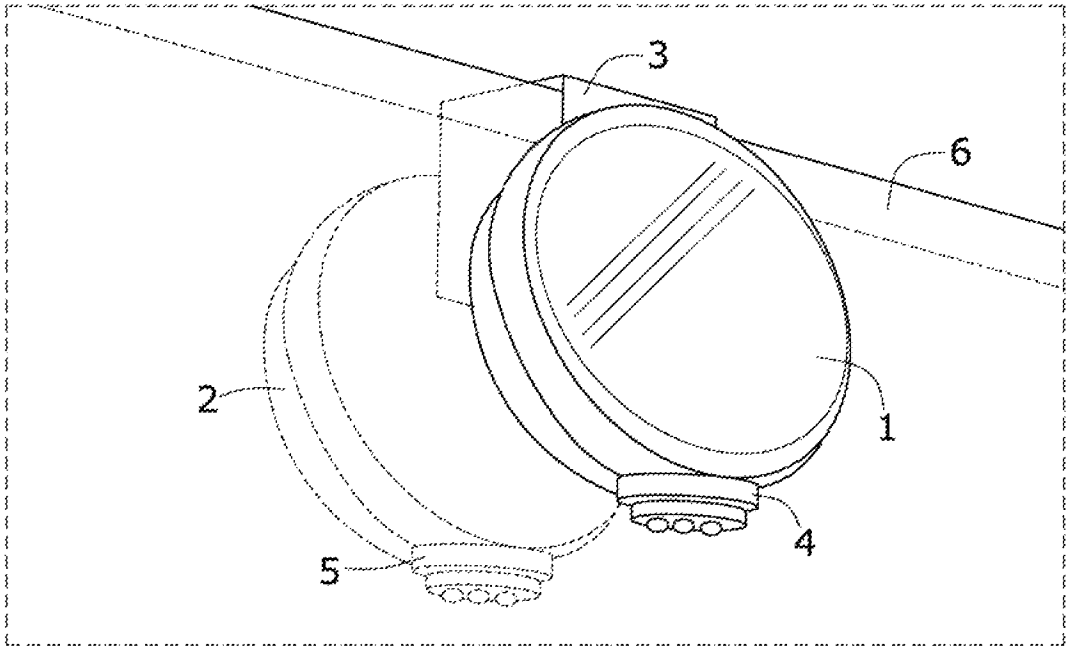
FIG. 2 shows the system mounted on the top edge of a door or element of passage.

In FIGS. 1 and 2 it is observed that the security system comprises a first fire detection element (1) joined by a flexible bridge (3) to a second fire detection element (2), the first fire detection element (1) has some lighting means (4), while the second fire detection element (2) has some lighting means (5).

The first and second lighting means (4) and (5) are preferably positioned on base of the detector and in a position that when activated project their light on the door or element of passage they are assembled on.

The luminous means (4) and (5) are preferably LEDs, which can be any other equivalent means, and they may have different colours, which will be activated according to the situations that may occur.

The first element of fire detection (1) and the second (2) are connected to transmit information between them, either wirelessly, by radio frequency or similarly, or even by an electrical connection, so that activation of one of them causes the activation of the other, in addition to turning the lighting means on, in particular some certain colours according to some previously established conditions.

So, in this way, first we get a simple and easy-positioning without installation that does not interfere at all with the operation of a door or element of passage, on the other hand, one has control over two different rooms, it can be used by the deaf, it also provides the information of whether or not to open the door or element of passage and finally, effective detection is obtained, as it is through the upper slits of the doors housed in their frames that the smoke preferably passes looking for an exit.

In FIG. 2, it is observed how the first fire detection element (1) and the second fire detection element (2) are joined by a flexible connecting bridge (3) which allows both detection elements to be suspended from the top edge of the door (6) and attached to each side of the door.

Having sufficiently described the nature of the present invention, as well as how to implement it, it must be noted that, in its essence, it may be put into practice in other forms of embodiment which differ in detail from that indicated by way of example, and which are also covered by the protection that is claimed, provided they do not alter, change or modify its fundamental principle.

The invention claimed is:

1. A fire safety system comprising a first fire detection element connected by means of a flexible bridge to a second fire detection element:

- the flexible connecting bridge suspends the first fire detection element and the second fire detection element from a top edge of a door, the first fire detection element is attached to a first side of the door and the second fire detection element is attached to a second side of the door;
- the first fire detection element has first lighting means on a base of the first fire detector element and the said second fire detection element has second lighting means on a base of the second fire detection element, the first and second lighting means are positioned in a position that when activated project light on the respective first side of the door or second side of the door or an element of passage below the top edge of the door the first and second lighting means are assembled on, the first and second lighting means are LEDs;
- the first fire detection element and the second fire detection element are connected by a connection in order to transmit information between them; and
- the fire safety system has means of communicating with other and similar systems, wherein the connection between first fire detection element and the second fire detection element for transmitting information between them, is either carried out wirelessly, by means of radio frequency or similar, or by means of an electrical connection, such that the activation of at least one of the fire detection elements produces the activation of the other one, so that activation of at least one of the first fire detection element and the second fire detection element causes activation of at least the other of the first fire detection element and the second fire detection element and the LEDs of one color are turned on according to previously pre-established conditions as indicator codes of the feasibility of the escape routes.

2. The fire safety system according to claim 1, wherein the LEDs are of different colors.

3. The fire safety system according to claim 1, wherein the fire detection elements comprise acoustic means.

4. The fire safety system according to claim 1, further comprising means of connecting with a smartphone to the fire safety system.

5. The fire safety system according to claim 1, wherein the fire detection system is integrated with an alarm or personal safety switchboard.

6. The fire safety system according to claim 1; wherein the fire detection elements that enable the communication with other similar systems act in a way that once one of them is activated, both the acoustic and lighting indication means of the rest of the systems to which it is connected are activated extending to establishing a safe escape route in the building where they are mounted.

* * * * *